US008378962B2

(12) United States Patent
Hsu et al.

(10) Patent No.: US 8,378,962 B2
(45) Date of Patent: Feb. 19, 2013

(54) LCD BACKLIGHT DRIVING DEVICE WITH AN ISOLATING TRANSFORMER

(75) Inventors: Cheng-Chia Hsu, Chupei (TW); Yu-Cheng Pan, Miaoli County (TW); Ho-Wen Chen, Taipei County (TW)

(73) Assignee: Logah Technology Corp., Chupei City, Hsinchu County (TW)

( * ) Notice: Subject to any disclaimer, the term of this patent is extended or adjusted under 35 U.S.C. 154(b) by 201 days.

(21) Appl. No.: 12/832,984

(22) Filed: Jul. 8, 2010

(65) Prior Publication Data

US 2010/0271358 A1 Oct. 28, 2010

Related U.S. Application Data

(63) Continuation-in-part of application No. 11/621,922, filed on Jan. 10, 2007, now abandoned.

(51) Int. Cl.
*G09G 3/36* (2006.01)

(52) U.S. Cl. ..... 345/102; 345/87; 345/211; 345/212; 315/212; 315/224; 315/209 R; 315/225; 315/226; 363/21.16; 363/21.08; 363/17; 363/16; 363/15; 349/61; 349/69; 349/70; 362/97.1; 362/97.2

(58) Field of Classification Search ..... 345/102, 345/104, 87; 315/212, 224, 209 R, 225, 315/226, 276, 283, 291, 307–308; 349/69–70; 362/97.1–97.3; 363/21.16, 21.08, 17, 16, 363/15

See application file for complete search history.

(56) References Cited

U.S. PATENT DOCUMENTS

| | | | | |
|---|---|---|---|---|
| 2006/0158132 | A1* | 7/2006 | Jang | 315/209 R |
| 2007/0002001 | A1* | 1/2007 | Park et al. | 345/102 |
| 2007/0057643 | A1* | 3/2007 | Zhang et al. | 315/291 |
| 2008/0084167 | A1* | 4/2008 | Waffenschmidt et al. | 315/210 |
| 2008/0088255 | A1* | 4/2008 | Wang et al. | 315/274 |

* cited by examiner

*Primary Examiner* — Lun-Yi Lao
*Assistant Examiner* — Olga Merkoulova
(74) *Attorney, Agent, or Firm* — Pai Patent & Trademark Law Firm; Chao-Chang David Pai

(57) ABSTRACT

An LCD backlight driving device with an isolating transformer comprises a DC power supply, a square wave generator, a square wave controller, said isolating transformer and a driver transformer; wherein said isolating transformer has a primary side connected to said square wave generator and a secondary side connected to said driver transformer, since said isolating transformer is placed between said square wave generator and said driver transformer, it helps to effectively shorten a safety distance required for setting up said driver transformer; the present invention uses said isolating transformer to shorten the safety distance required than that of using said driver transformer directly and to decrease an area in implementing a circuit board and to cut cost of said device.

3 Claims, 4 Drawing Sheets

LCD BACKLIGHT DRIVING DEVICE WITH AN ISOLATING TRANSFORMER

CROSS REFERENCE TO RELATED APPLICATIONS

This application is a continuation-in-part of pending U.S. patent application Ser. No. 11/621,922, filed on Jan. 10, 2007, the disclosure of which is hereby incorporated by reference herein in its entirety.

BACKGROUND OF THE INVENTION

1. Field of the Invention

The present invention relates to an LCD backlight driving device with an isolating transformer, and more particularly, to an LCD backlight driving device using an isolating transformer to reduce the manufacturing cost of the LCD backlight driving device.

2. Description of the Prior Art

Please refer to FIG. 1 for an implementation of a prior-art LCD backlight driving device. In FIG. 1, a prior-art LCD backlight driving device 1 uses a driver transformer 11 to boost the AC signal from 400V at the primary side to 1200V at the secondary side to drive a cold cathode fluorescent lamp 12. However, in order to comply with the safety distance requirement, the driver transformer 11 must have a spacing of at least 18 mm between its primary and secondary side. Suppose one driver transformer 11 is used to drive one cold cathode fluorescent lamp 12, then the area of driving circuit board comprising a plurality of driver transformers 11 will be significantly large and therefore raise the manufacturing cost.

Therefore, the above-mentioned implementation of a prior-art LCD backlight driving device presents several shortcomings to be overcome.

In view of the above-described deficiencies of prior-art LCD backlight driving device, after years of constant effort in research, the inventor of this invention has consequently developed and proposed an LCD backlight driving device with an isolating transformer in the present invention.

SUMMARY OF THE INVENTION

It is an object of the present invention to provide an LCD backlight driving device with an isolating transformer to effectively shorten the safety distance required in implementing the driver transformer and to further reduce an area of the circuit board and to cut cost of the device.

It is another object of the present invention to provide an LCD backlight driving device with an isolating transformer to improve stability in using the device, to extend the product lifetime, to cut back the transformer size and to save space.

The present invention discloses an LCD backlight driving device with an isolating transformer, which comprises a DC power supply, a square wave generator, a square wave controller, said isolating transformer and a driver transformer; wherein said isolating transformer has a primary side connected to said square wave generator and a secondary side connected to said driver transformer, since said isolating transformer is placed between said square wave generator and said driver transformer, it helps to effectively shorten a safety distance required for setting up said driver transformer; the present invention uses said isolating transformer to shorten the safety distance required than that of using said driver transformer directly and to decrease an area in implementing a circuit board and to cut cost of said device.

These features and advantages of the present invention will be fully understood and appreciated from the following detailed description of the accompanying Drawings.

DETAILED DESCRIPTION OF THE PREFERRED EMBODIMENT

Figure 1:
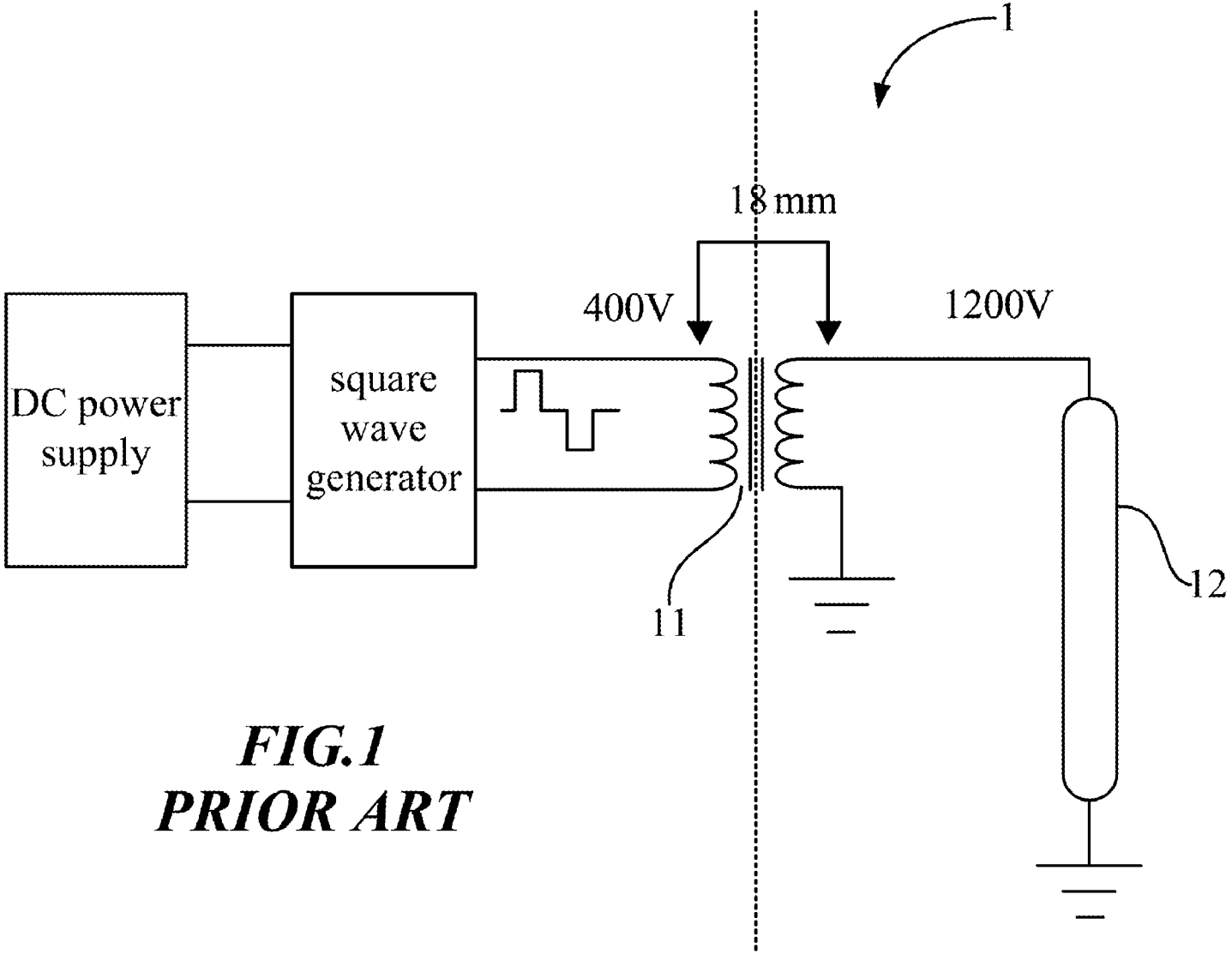
FIG.1 PRIOR ART
FIG. 1 illustrates an implementation of a prior-art LCD backlight driving device.
Figure 2:
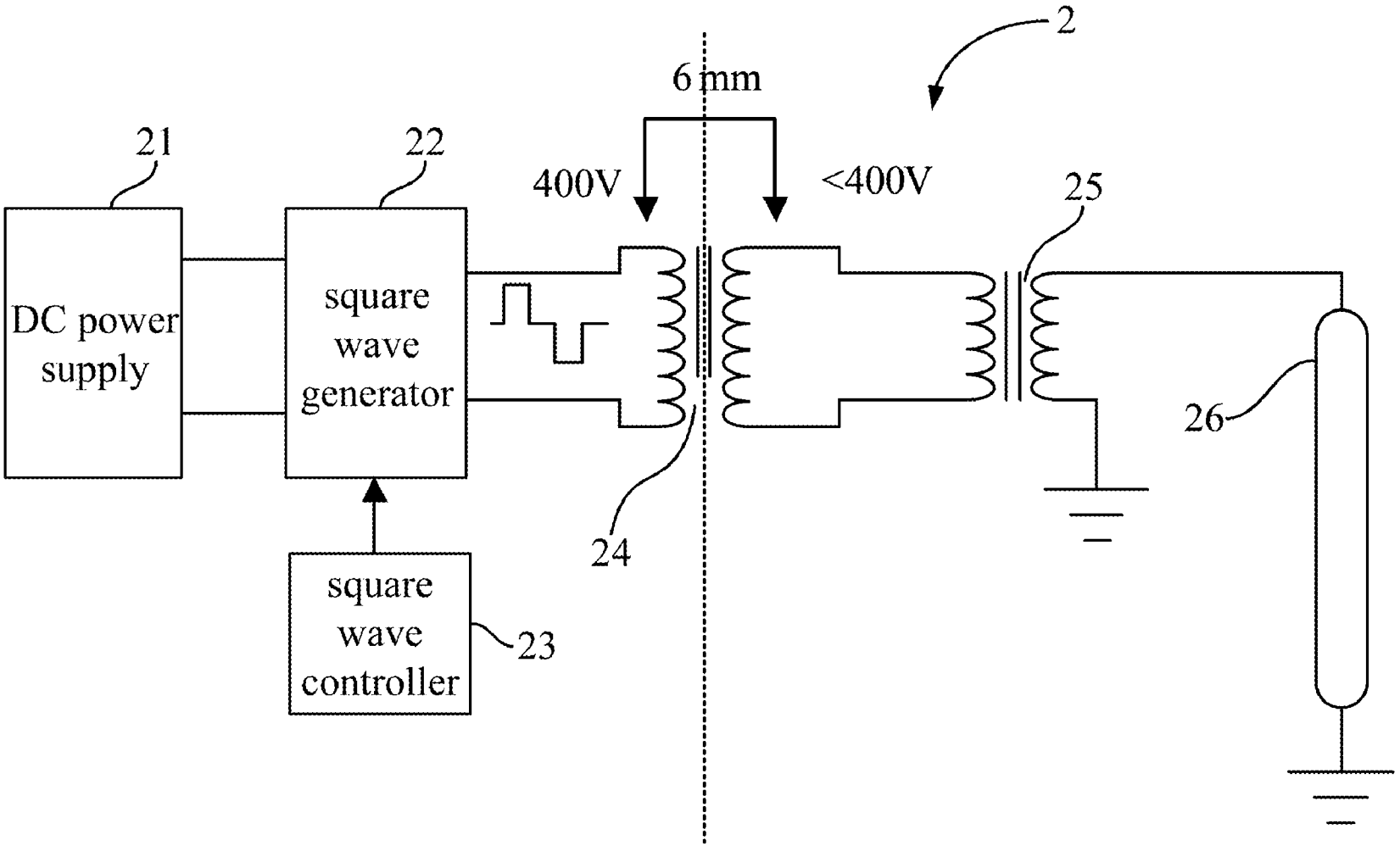
FIG. 2 illustrates a first embodiment of an LCD backlight driving device with an isolating transformer disclosed in the present invention.

Please refer to FIG. 2, which illustrates a first embodiment of an LCD backlight driving device with an isolating transformer disclosed in the present invention. From the figure, an LCD backlight driving device with an isolating transformer 2 comprises:

a DC power supply 21 for outputting a DC signal to a square wave generator 22;

the square wave generator 22 for converting the DC signal into an AC signal and outputting the AC signal to a primary side of a isolating transformer 24;

a square wave controller 23 for outputting a control signal to the square wave generator 22;

the isolating transformer 24 for receiving the AC signal from the square wave generator 22, and then outputting the AC signal to a primary side of a driver transformer 25 by a secondary side of the isolating transformer 24; and the driver transformer 25 for boosting the AC signal inputted by the isolating transformer 24, and then outputting a boosted AC signal to a cold cathode fluorescent lamp 26 by a secondary side of the driver transformer 25.

For an input voltage of 400V at the primary side of the isolating transformer 24, an output voltage of the secondary side of the isolating transformer 24 will be less than 400V. Therefore the safety spacing between the primary and the secondary side of the isolating transformer 24 is only 6 mm. The present invention uses the isolating transformer to effectively shorten the safety distance required than that of using said driver transformer directly and to decrease an area in implementing a circuit board and to cut cost of the device.

Figure 3:
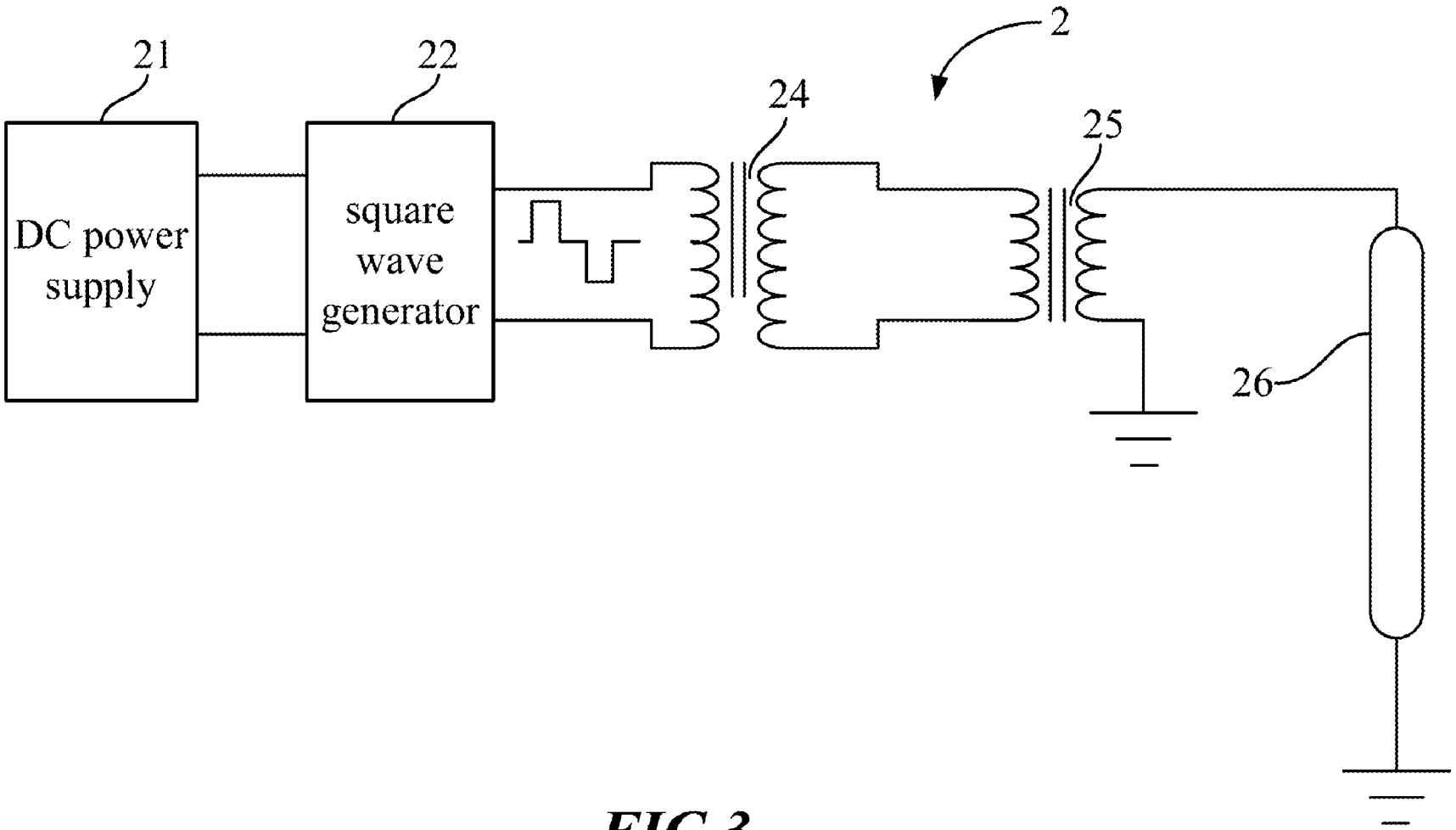
FIG. 3 illustrates a second embodiment of an LCD backlight driving device with an isolating transformer disclosed in the present invention.

Please refer to FIG. 3, which illustrates a second embodiment of an LCD backlight driving device with an isolating transformer disclosed in the present invention. From the figure, an LCD backlight driving device with an isolating transformer 2 comprises:

a DC power supply 21 for outputting a DC signal to a square wave generator 22;

the square wave generator 22 for converting the DC signal into an AC signal and outputting the AC signal to a primary side of a isolating transformer 24;

the isolating transformer 24 for receiving the AC signal from the square wave generator 22, and then outputting the AC signal to a primary side of a driver transformer 25 by a secondary side of the isolating transformer 24; and the driver transformer 25 for boosting the AC signal inputted by the isolating transformer 24, and then outputting a boosted AC signal to a cold cathode fluorescent lamp 26 by a secondary side of the driver transformer 25.

Figure 4:
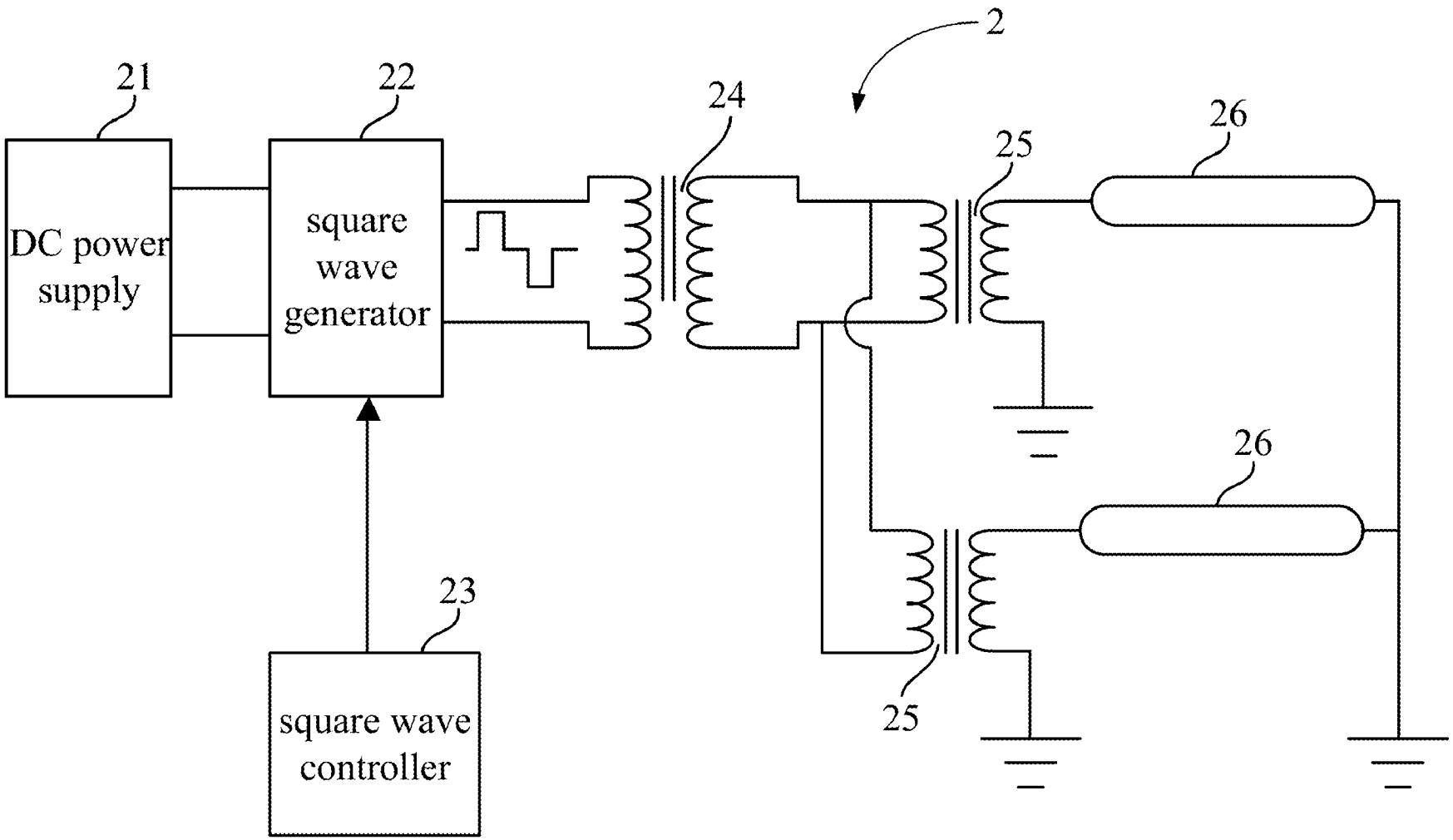
FIG. 4 illustrates a third embodiment of an LCD backlight driving device with an isolating transformer disclosed in the present invention.

Please refer to FIG. 4, which illustrates a third embodiment of an LCD backlight driving device with an isolating transformer disclosed in the present invention. From the figure, an LCD backlight driving device with an isolating transformer 2 comprises:

a DC power supply 21 for outputting a DC signal to a square wave generator 22;

the square wave generator 22 for converting the DC signal into an AC signal and outputting the AC signal to a primary side of the isolating transformer 24;

a square wave controller 23 for outputting a control signal to the square wave generator 22;

the isolating transformer 24 for receiving the AC signal from the square wave generator 22, and then outputting the AC signal to primary sides of a plurality of driver transformers 25 by a secondary side of the isolating transformer 24; and the plurality of driver transformers 25 for boosting the AC signal inputted by the isolating transformer 24, and then outputting the boosted AC signal to a plurality of cold cathode fluorescent lamp s by secondary sides of the plurality of driver transformers 25.

The present invention discloses an LCD backlight driving device with an isolating transformer which, while comparing with conventional techniques, is advantageous in:

1. The present invention provides an LCD backlight driving device with an isolating transformer to effectively shorten the safety distance required in implementing the driver transformer and to further reduce an area of the circuit board and to cut cost of the device.

2. The present invention provides an LCD backlight driving device with an isolating transformer to improve stability in using the device, to extend the product lifetime, to cut back the transformer size and to save space.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An LCD backlight driving device with an isolating transformer, comprising:

a DC power supply for outputting a DC signal to a square wave generator;

said square wave generator for converting said DC signal into an AC signal and outputting said AC signal to a primary side of said isolating transformer;

a square wave controller for outputting a control signal to said square wave generator;

said isolating transformer for receiving said AC signal from said square wave generator, and then outputting said AC signal to a primary side of a driver transformer by a secondary side of said isolating transformer; and said driver transformer for boosting said AC signal inputted by said isolating transformer, and then outputting a boosted AC signal to a cold cathode fluorescent lamp by a secondary side of said driver transformer, wherein the primary side of said isolating transformer has an input voltage of 400V, and said isolating transformer has a safety spacing of 6 mm between the primary side and the secondary side.

2. An LCD backlight driving device with isolating transformer, comprising:

a DC power supply for outputting a DC signal to a square wave generator;

said square wave generator for converting said DC signal into an AC signal and outputting said AC signal to a primary side of said isolating transformer;

said isolating transformer for receiving said AC signal from said square wave generator, and then outputting said AC signal to a primary side of a driver transformer by a secondary side of said isolating transformer; and said driver transformer for boosting said AC signal inputted by said isolating transformer, and then outputting a boosted AC signal to a cold cathode fluorescent lamp by a secondary side of said driver transformer, wherein the primary side of said isolating transformer has an input voltage of 400V, and said isolating transformer has a safety spacing of 6 mm between the primary side and the secondary side.

3. An LCD backlight driving device with isolating transformer, comprising:

a DC power supply for outputting a DC signal to a square wave generator;

said square wave generator for converting said DC signal into an AC signal and outputting said AC signal to a primary side of said isolating transformer;

a square wave controller for outputting a control signal to said square wave generator;

said isolating transformer for receiving said AC signal from said square wave generator, and then outputting said AC signal to primary sides of a plurality of driver transformers by a secondary side of said isolating transformer; and said plurality of driver transformers for boosting said AC signal inputted by said isolating transformer, and then outputting said boosted AC signal to a plurality of cold cathode fluorescent lamps by secondary sides of said plurality of driver transformers, wherein the primary side of said isolating transformer has an input voltage of 400V, and said isolating transformer has a safety spacing of 6 mm between the primary side and the secondary side.

* * * * *